US006973919B2

(12) United States Patent
Joos et al.

(10) Patent No.: US 6,973,919 B2
(45) Date of Patent: Dec. 13, 2005

(54) INTERNAL COMBUSTION ENGINE AND METHOD, COMPUTER PROGRAM AND CONTROL APPARATUS FOR OPERATING THE INTERNAL COMBUSTION ENGINE

(75) Inventors: Klaus Joos, Walheim (DE); Jens Wolber, Gerlingen (DE); Thomas Frenz, Noerdlingen (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 150 days.

(21) Appl. No.: 10/259,419

(22) Filed: Sep. 30, 2002

(65) Prior Publication Data

US 2003/0062027 A1 Apr. 3, 2003

(30) Foreign Application Priority Data

Sep. 28, 2001 (DE) ..... 101 48 217

(51) Int. Cl.[7] ..... F02M 51/00

(52) U.S. Cl. ..... 123/478; 123/480

(58) Field of Search ..... 123/478, 480

(56) References Cited

U.S. PATENT DOCUMENTS 6,349,705 B1 * 2/2002 Pirkl et al. ..... 123/490
6,486,587 B2 * 11/2002 Klenk et al. ..... 310/316.03
6,499,464 B2 * 12/2002 Rueger ..... 123/446

* cited by examiner

*Primary Examiner*—John T. Kwon
(74) *Attorney, Agent, or Firm*—Walter Ottesen

(57) ABSTRACT

In an internal combustion engine, the fuel reaches the combustion chamber of the engine via a fuel-injection device which includes a piezo actuator (50). In order to be able to optimally inject the fuel, it is suggested that the desired level (U_DES) of the drive energy (U) and/or the desired gradient (dU_DES) of the drive energy (U), with which the piezo actuator (50) is driven, is dependent upon a plurality of influence quantities (T, t, n, dx, dh) which influence the operating behavior of the piezo actuator (50).

24 Claims, 4 Drawing Sheets

INTERNAL COMBUSTION ENGINE AND METHOD, COMPUTER PROGRAM AND CONTROL APPARATUS FOR OPERATING THE INTERNAL COMBUSTION ENGINE

FIELD OF THE INVENTION

The invention relates to a method for operating an internal combustion engine wherein the fuel reaches a combustion chamber of the engine via a fuel-injection device which is equipped with a piezo actuator.

The invention also relates to an internal combustion engine as well as to a computer program and control apparatus for operating the engine.

BACKGROUND OF THE INVENTION

A method of the above kind is disclosed in German published patent application 198 44 837. In this publication, a fuel-injection valve is shown having a valve element connected to a piezo actuator. When a voltage is applied to the piezo actuator, the latter experiences a change of length which it transfers to the valve element. The valve element then lifts from its valve seat so that fuel can be injected at a high pressure out of the injection valve into the combustion chamber of the engine.

SUMMARY OF THE INVENTION

It is an object of the invention to provide a method of the kind mentioned above which is so improved that the fuel can be injected with still greater precision.

The method of the invention is for operating an internal combustion engine wherein fuel reaches a combustion chamber of the engine via a fuel injection device equipped with a piezo actuator. The method includes the steps of: providing means for supplying drive energy (U) for driving and actuating the piezo actuator with the drive energy (U) having a desired level (U_DES) and a desired gradient (dU_DES); and, causing at least one of the desired level (U_DES) and the desired gradient (dU_DES) to be dependent upon a plurality of influence quantities (T, t, n, dx, dh) which influence the operating behavior of the piezo actuator.

With the method of the invention, the fuel quantity, which is outputted by the injection device, can be adjusted with a very high precision. This operates, on the one hand, favorably on the fuel consumption of the engine and leads, on the other hand, to an improved emission performance of an engine operated in this way. According to the invention, it is recognized that two identical piezo actuators do not necessarily require the same drive energy for a specific opening stroke. Instead, the operating behavior of a piezo actuator is subjected to influence quantities which lead to the condition that an individual drive energy and an individual trace of the drive energy is required for a specific opening stroke and a specific trace of the opening movement This is taken into account in the method according to the invention.

If an internal combustion engine includes several fuel-injection devices having several piezo actuators, it is then possible to pregive the drive energy and/or the trace of the drive energy individually for each piezo actuator in order to compensate the influence of individual influence quantities. However, if we are concerned with influence quantities which operate on the entire group of piezo actuators, an adaptation of the drive energy and/or of the trace of the drive energy can be carried out for the group of piezo actuators.

In a first embodiment, it is suggested that the current values of the influence quantities for generating a corrected desired drive energy are used. The term "current" is here understood to mean that the values are detected close in time to the intended injection via the fuel-injection device. In this way, consideration can also be given to changes of the influence quantities if and when they occur. The precision of the injection is still further improved by this embodiment.

In an especially advantageous embodiment of the method of the invention, it is suggested that: a standard drive energy is defined which must be supplied to the piezo actuator at standard conditions in order to achieve a specific actuation; the current values of the influence quantities are determined or detected; for each influence quantity, a corrective factor is determined which corresponds to the current value of the influence quantity; and, the corrective factors are applied to the standard drive energy so that a corrected desired drive energy is determined. This method is simple to realize and provides good results.

In the same manner, it is also possible that the current values of the influence quantities are used for generating a corrected desired gradient for the increase of the drive energy. In this embodiment too, an optimal compensation of the influence of the influence quantities on the operating behavior of the piezo actuator is achieved via the close-in-time detection of the influence quantities.

Such a method is especially easy to realize in that: a standard gradient is defined according to which the drive energy must be changed for standard conditions in order to achieve a specific actuation without the piezo actuator overshooting; the current values of the influence quantities are detected or determined; a corrective factor is determined for each influence quantity which corresponds to the current value of the influence quantity; and, the corrective factors are applied to the standard gradient so that a corrected desired gradient is determined.

Alternatively to the above, it is possible that a corrected desired drive energy is divided by a time duration within which the corrected drive energy may be achieved without the piezo actuator overshooting and, from this, the corrected desired gradient is determined. This method, too, is simple to realize and can, for example, be carried out in an "intelligent" output stage.

It is also possible that at least one corrective factor is determined via a characteristic line from the corresponding influence quantity. Such a characteristic line makes possible the consideration also of non-linear interrelationships between the influence quantity and the corrective factor. This, in turn, augments the precision of the compensation of the influence of the influence quantity and finally therefore the precision of the injection.

Furthermore, the corrected desired drive energy and/or the corrected desired gradient can be determined with the aid of at least one corrective function. Such a corrective function can consider additive and/or multiplicative corrective factors in a simple manner.

An especially high accuracy together with a simultaneously high computation speed is achieved when the corrected desired drive energy and/or the corrected desired gradient is determined with the aid of a characteristic line and/or with the aid of a multi-dimensional characteristic field.

In a further embodiment of the method of the invention, it is further suggested that the influence quantities include at least two of the following group: temperature, deterioration, manufacturing tolerances and desired stroke. These influence quantities are those which have the largest influence on the operating behavior of the piezo actuator. The temperature of the piezo actuator can be detected in various ways, for example, via a temperature sensor mounted on the actuator, or, for example, even via the determination of the temperature of the cylinder head. The deterioration of the piezo actuator can include a purely time-dependent component (service life) and/or a component (wear) dependent upon the number of actuations.

The manufacturing tolerances can, in turn, be determined, for example, from the torque differences which occur on the crankshaft for two different fuel-injection devices which are driven sequentially with the same drive energy and with the same trace of the drive energy. By considering the desired stroke, the fact is taken into consideration that a piezo actuator can execute different strokes in dependence upon the magnitude of the drive energy. With a shorter desired stroke, it can, however, be that the influence quantities have another influence quantitatively and qualitatively on the operating behavior of the piezo actuator than for a full stroke.

The invention also relates to a computer program, which is suitable for carrying out the above method when it is executed on a computer. Here, it is especially preferred when the computer program is stored on a memory, especially on a flash memory.

The subject matter of the invention is also a control apparatus (open loop and/or closed loop) for operating an internal combustion engine. In order to operate the engine with respect to optimal power and optimal emission, it is suggested that the control apparatus include a memory on which a computer program of the above kind is stored.

Furthermore, the invention relates to an internal combustion engine having a combustion chamber and having a fuel-injection device which includes a piezo actuator (50) and via which the fuel gets into the combustion chamber (20).

So that the engine can be operated optimally with respect to power and emissions, it is provided that the engine include a control apparatus, which processes a plurality of influence quantities in the determination of a desired level of drive energy and/or of the desired gradient of the drive energy and that the piezo actuator is so driven that the influences of the plurality of influence quantities are substantially compensated.

It is, in turn, especially preferred when the internal combustion engine includes a control apparatus of the above kind.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
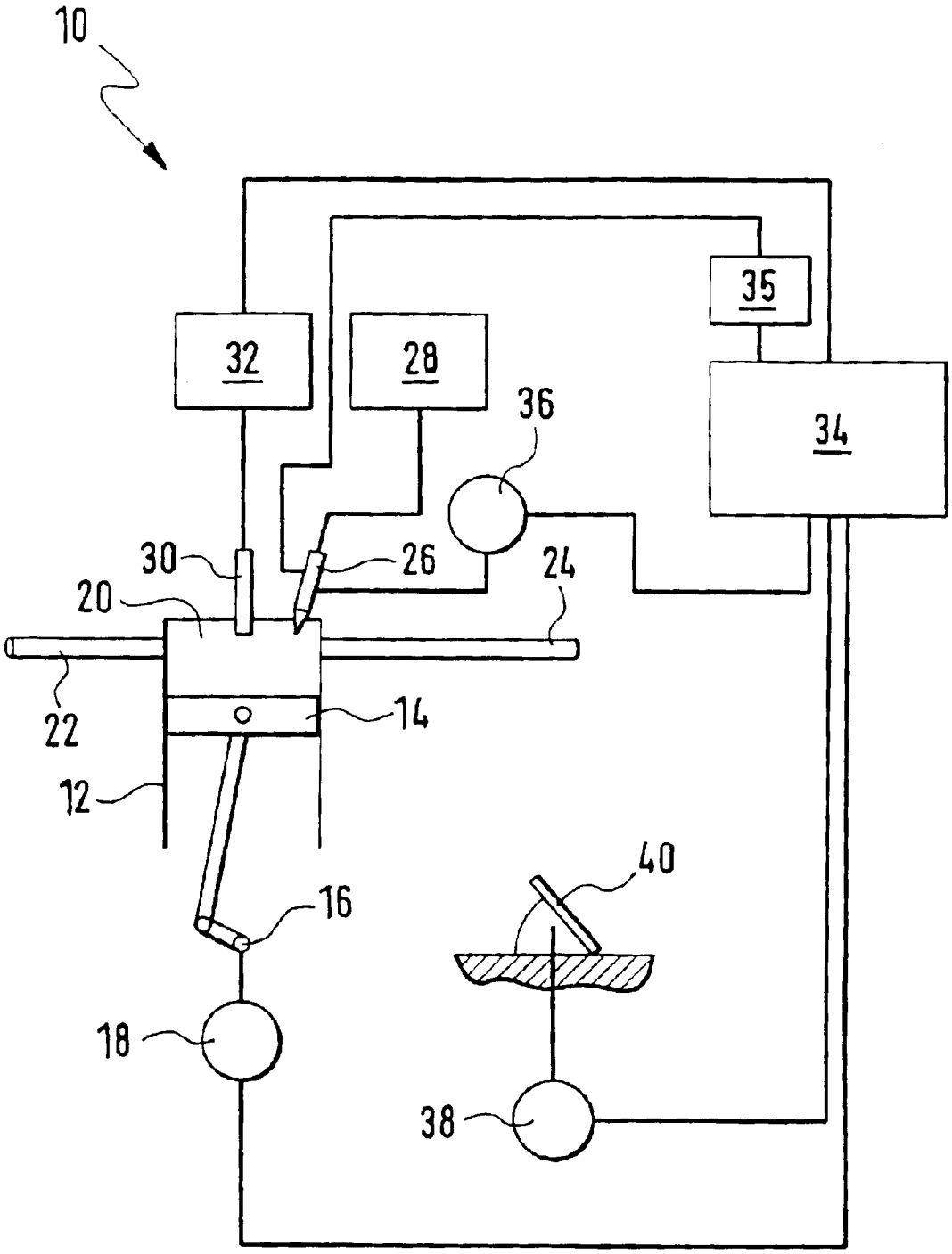
FIG. 1 is a schematic of an internal combustion engine.

In FIG. 1, an internal combustion engine is identified by reference numeral 10. The engine is mounted in a motor vehicle that includes several cylinders, of which only one is shown in FIG. 1 and is identified by reference numeral 12. A piston 14 is accommodated in the cylinder 12 and drives a crankshaft 16. The rpm of the crankshaft 16 is tapped by an rpm sensor 18.

Combustion air is supplied via an inlet channel 22 and an inlet valve (not shown in FIG. 1) to a combustion chamber 20 of the cylinder 12. The combustion exhaust gases are directed away from the combustion chamber 20 via an exhaust-gas pipe 24. The exhaust-gas pipe 24 is connected to the combustion chamber 20 via an outlet valve (not shown). Fuel is injected directly into the combustion chamber 20 via a fuel-injection device configured as an injector 26. The injector 26 is connected to a fuel system 28, which is shown only symbolically in FIG. 1. The fuel system includes a fuel tank, a feed supply pump, a primary supply pump and a fuel rail wherein the fuel is stored under high pressure. The injector 26 is connected to the fuel rail.

The fuel disposed in the combustion chamber 20 is ignited by a spark plug 30. The spark plug receives the energy needed for the ignition from an ignition system 32. The ignition system 32 is, in turn, driven by a control apparatus 34. The control apparatus is also connected at the output end to the injector 26 via an output stage 35 and controls the injector. The control apparatus 34 receives signals at its input end from a temperature sensor 36, which detects the temperature of the injector 26. Furthermore, the rpm sensor 18 is connected to the control apparatus 34. A position transducer 38 taps the position of an accelerator pedal 40 and likewise supplies signals to the control apparatus 34.

Figure 2:
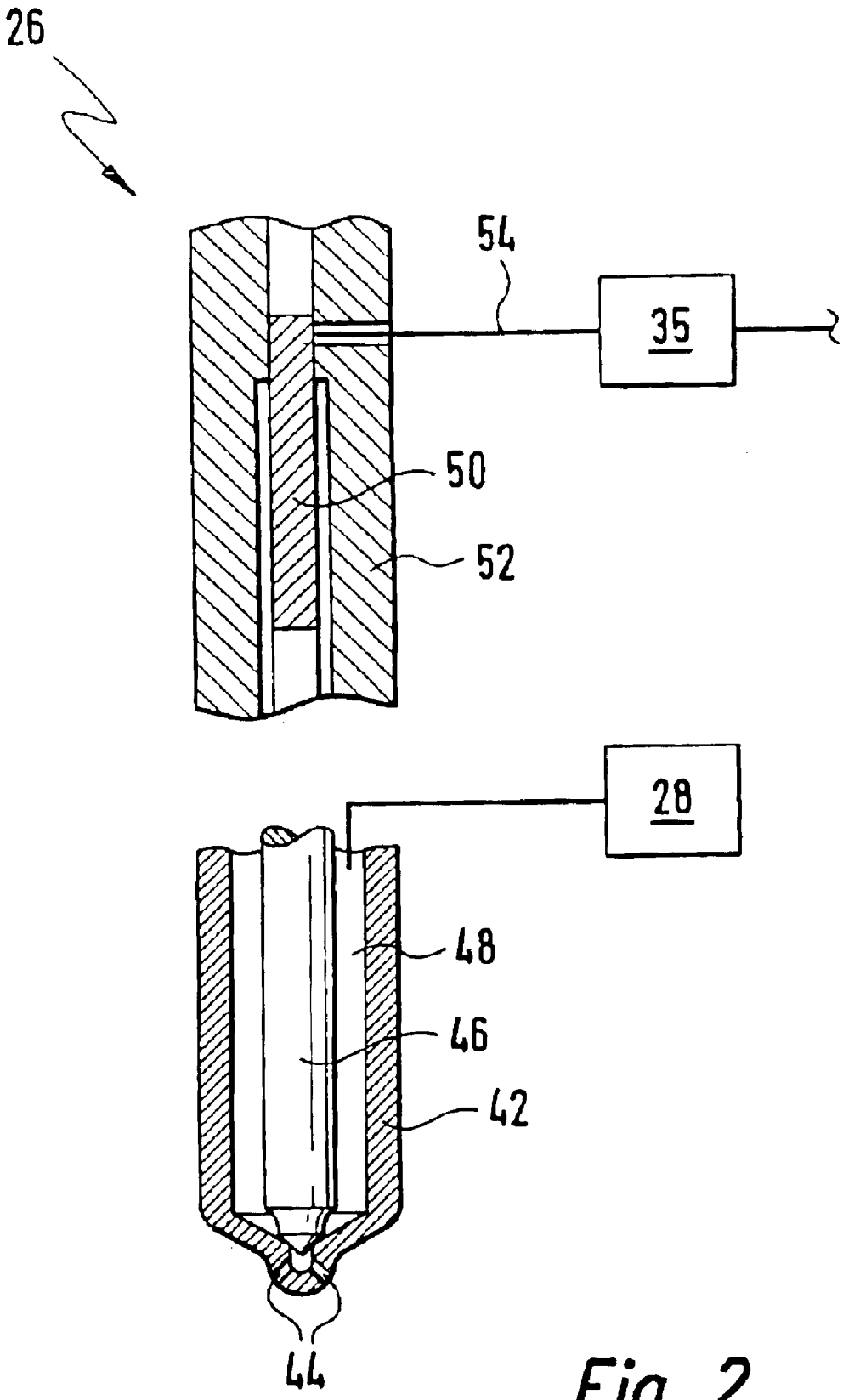
FIG. 2 is a detail section view of a fuel-injection device of the internal combustion engine of FIG. 1.

The injector 26 (see FIG. 2) includes a valve body 42 having an end at the combustion chamber with several outlet openings 44 for the fuel distributed over the periphery. These outlet openings 44 can be connected via a valve needle 46 to an annular chamber 48, which, in turn, is connected to the fuel system 28. The end of the valve needle 46, which faces away from the outlet openings 44, is fixedly coupled to a piezo actuator 50 (a hydraulic coupling is also possible in an embodiment not shown). The piezo actuator 50 is a column made up of layers of a plurality of individual piezo elements. The end of the piezo actuator 50, which faces away from the valve needle 46, is clamped with a housing 52 of the injector. The piezo actuator 50 is connected to the output stage 35 via control lines 54. The drive energy, which is required for the movement of the piezo actuator 50, is supplied via the output stage 35 to the piezo actuator 50 in a manner to be described hereinafter.

The internal combustion engine 10 operates with gasoline-direct injection and can operate in stratified operation as well as in homogeneous operation. In stratified operation, an ignitable fuel mixture is present only in the region of the spark plug 30, whereas the remaining part of the combustion chamber 20 is at least at first substantially free of fuel. This is achieved in that the injector 26 injects fuel during a compression stroke of the piston 14. It is, however, also possible that the fuel is injected by the injector 26 during a suction stroke of the piston 14, which leads to the situation that the fuel is present substantially distributed homogeneously in the combustion chamber 20 of the engine 10. Also, other combinations are possible.

To realize an injection, an electrical drive energy is applied to the injector 26 from the control apparatus 34 via the output stage 35. This drive energy leads to the situation that the piezo actuator 50 shortens in the longitudinal direction. In this way, the valve needle 46 is lifted from its valve seat on the valve body 42 so that the outlet openings 44 are connected to an annular space 48 and finally to the fuel system 28. The valve seat is present in the region of the outlet openings 44. If the injection is to be ended, then the charge of the piezo actuator 50 with the drive energy is ended so that the piezo actuator again assumes its initial length and the valve needle 46 comes into contact against its valve seat.

The length change of the piezo actuator 50, which the latter experiences when an electric voltage is applied thereto, is, however, not only dependent upon the magnitude of the electric voltage, but rather also on various other quantities, which cannot be influenced by the user of the engine or can only be influenced with difficulty. These quantities, therefore, influence the operating behavior of the piezo actuator 50 and are therefore characterized as "influence quantities". One such influence quantity is, for example, the temperature T of the piezo actuator 50 (see FIG. 3). The temperature is detected by the temperature sensor 36 and is transmitted to the control apparatus 34 (alternatively, the temperature can also be determined from a model).

A further influence quantity is the deterioration of the piezo actuator 50. Here, deterioration is not only understood to be the age (t) which, for example, can be measured in days, months and/or years, but also the number (n) of the strokes which the piezo actuator 50 has already executed in the course of its service life. The age (t) is detected by a time transducer present in the control apparatus 34. The number of strokes (n) is stored in the control apparatus 34 and is, for example, determined from the rpm of the crankshaft 16 tapped by the rpm sensor 18. Here, it is noted at this point that deterioration effects of the piezo actuator can be recognized also via a so-called cylinder equalization function and a mixture adaptation.

A further influence quantity is the manufacturing tolerance with which the piezo actuator 50 was manufactured. Because of different conditions in the manufacture of the piezo actuator 50, it can happen for the same drive energy and for the identical piezo actuators, the latter execute different strokes. For a multi-cylinder engine, this would lead to injection quantities different from one cylinder to the other.

The above was met up to now with a so-called cylinder equalization wherein the accelerations of the crankshaft 16 are measured after the ignition of the mixture in the corresponding cylinder 12. From the deviations, a conclusion can be drawn as to the differently injected fuel quantity and the different strokes of the individual piezo actuators 50 for the same drive energy.

The above was compensated up to now in that the duration of one of the drive pulses of the individual piezo actuators 50 is adapted in order to obtain a torque trace as uniform as possible within a work cycle of the crankshaft 16. In the present case, the rotation non-uniformities of the crankshaft 16, which are determined by the rpm sensor 18, are, however, stored as influence quantities dx in a memory in the control apparatus 34 and these influence quantities correspond to manufacturing tolerances of the piezo actuators.

Even the magnitude of the desired stroke of the piezo actuator 50 is an influence quantity in the above sense. It is possible, for example, that only a very small fuel quantity is to be injected. In such a case, it can be necessary to again interrupt the development of the drive energy already during the increase of the drive energy. Such an operation also influences the operating behavior of the injector of the piezo actuator 50, which is present in the control apparatus 34 as influence quantity dh.

The above influence quantities are primarily current values, which have been detected or determined close in time to the planned injection. According to the method shown in FIG. 3, corrective factors CF_T, CF_dx and CF_dh are formed from the above-mentioned influence factors T, dx and dh via characteristic lines 56, 58 and 60. The influence quantities t and n are processed in a characteristic field 60 to a corrective factor CF_nt. The use of characteristic lines 56, 58 and 60 and of the characteristic field 62 makes it possible to also consider non-linear interrelationships. The above corrective factors could be fed into a multi-dimensional characteristic field, which generates a desired value U_DES for the drive voltage. Here, a corrective function 64 is, however, used wherein the corrective factors CF_t, CF_nt, CF_dx and CF_dh are processed multiplicatively and/or additively and the desired drive voltage U_DES is computed thereby.

A desired gradient dU_DES is determined from the desired drive voltage U_DES by means of a characteristic line 66. This desired gradient dU_DES is the speed with which the drive voltage U_DES is to be approached. The characteristic line 66 is so selected that the desired stroke is reached as rapidly as possible without the piezo actuator 50 overshooting in an unwanted manner. It would also be possible to determine the gradient dU_DES in that the drive voltage U_DES, which is determined in the characteristic field 62, is divided by a time duration within which the corrected desired drive voltage U_DES may be reached without the piezo actuator 50 overshooting. The corrective function 64 and the characteristic line 66 are also characterized as "central drive functions" with which several influence quantities are considered in the determination of the desired drive energy for the piezo actuator 50.

The desired voltage U_DES and the desired gradient dU_DES are transmitted in the form of a drive signal 70 to the output stage 35 via an interface 68. A clock module 72 triggers the drive signal 70 in the output stage 35 in correspondence to the position of the accelerator pedal 40, which is tapped by the position transducer 38 so that the injection duration, which corresponds to the desired torque, is generated at the injector 26. The trigger signal is rectangular and is identified by reference numeral 74 in FIG. 3. From the drive signal 70 and the trigger signal 74, the actual control voltage U is generated in the output stage 35, which climbs and falls at a gradient dU_dt. This signal is identified by reference numeral 76 in FIG. 3.

At this point, it is noted that, as an alternative, an "intelligent" output stage can also be used wherein the central drive function is integrated.

Figure 3:
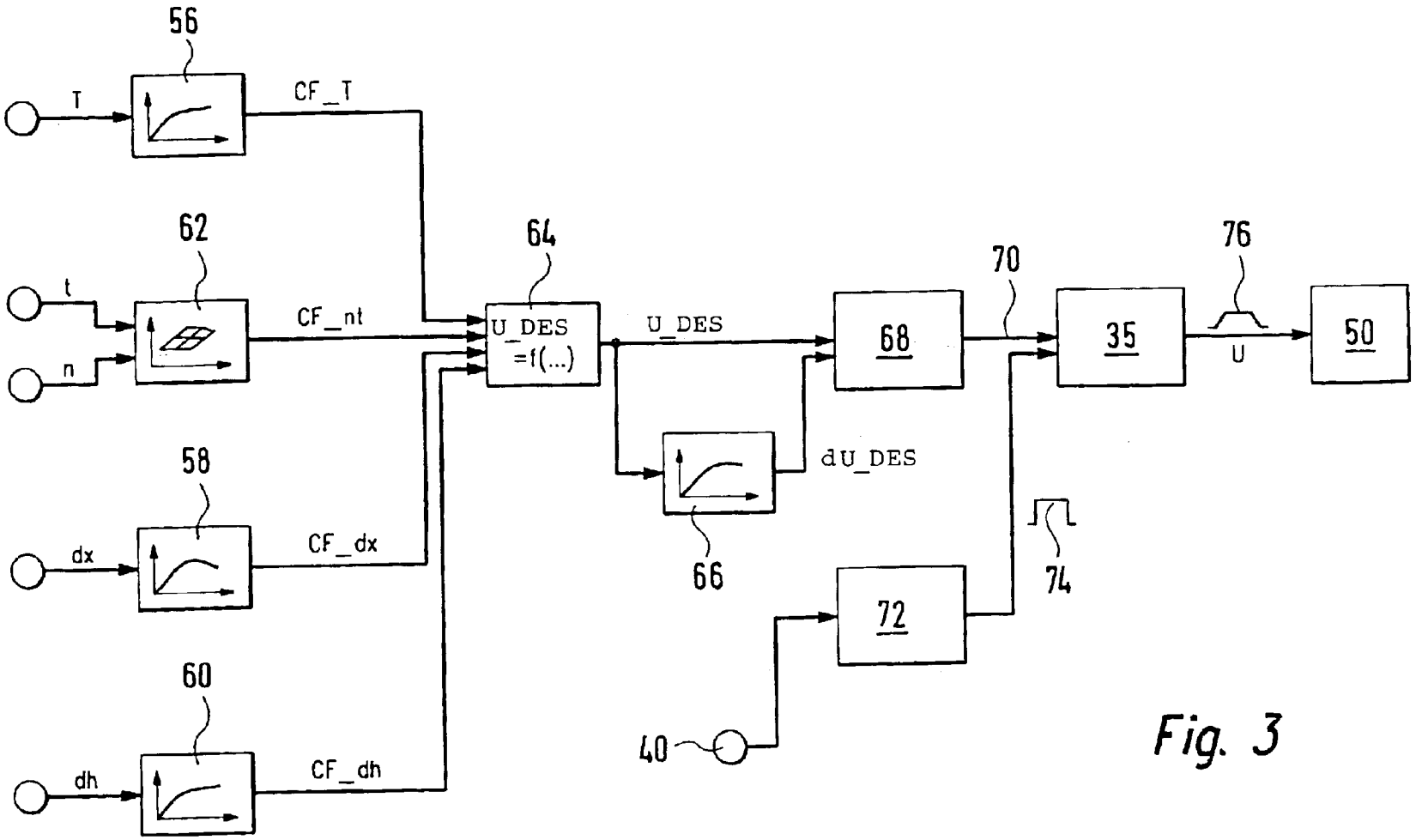
FIG. 3 is a sequence diagram according to which the engine of FIG. 1 or the fuel-injection device of FIG. 2 is operated.
Figure 4:
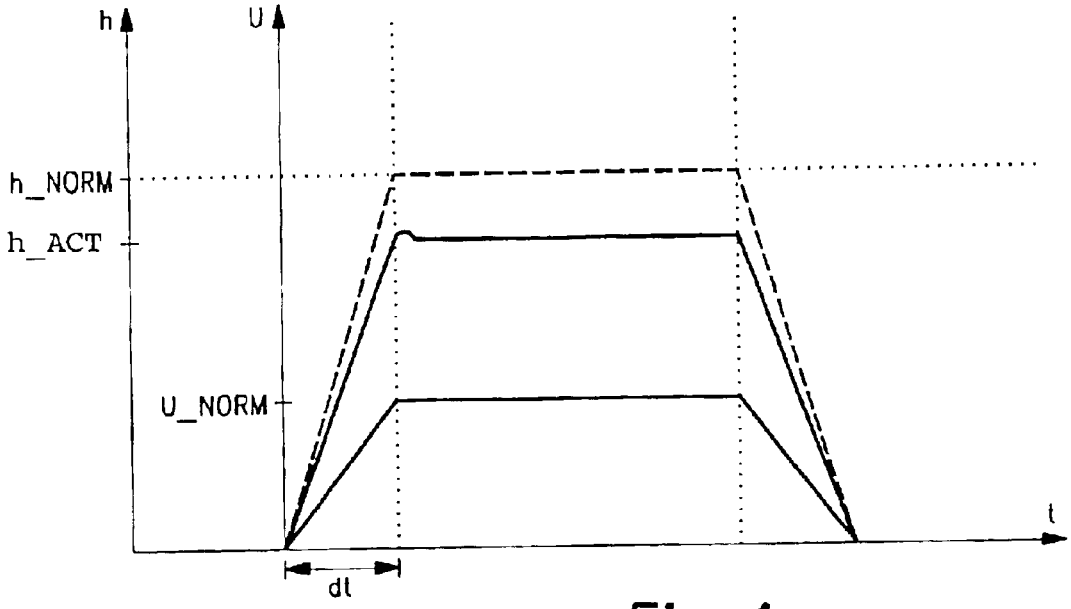
FIG. 4 is a diagram showing the drive energy and the corresponding stroke of the fuel-injection device of FIG. 2 without the application of the method set forth in FIG. 3; and, FIG. 5 is a diagram similar to FIG. 4, wherein the drive energy and the corresponding stroke of the fuel-injection device of FIG. 2 are shown with the application of the method shown in FIG. 3.
Figure 5:
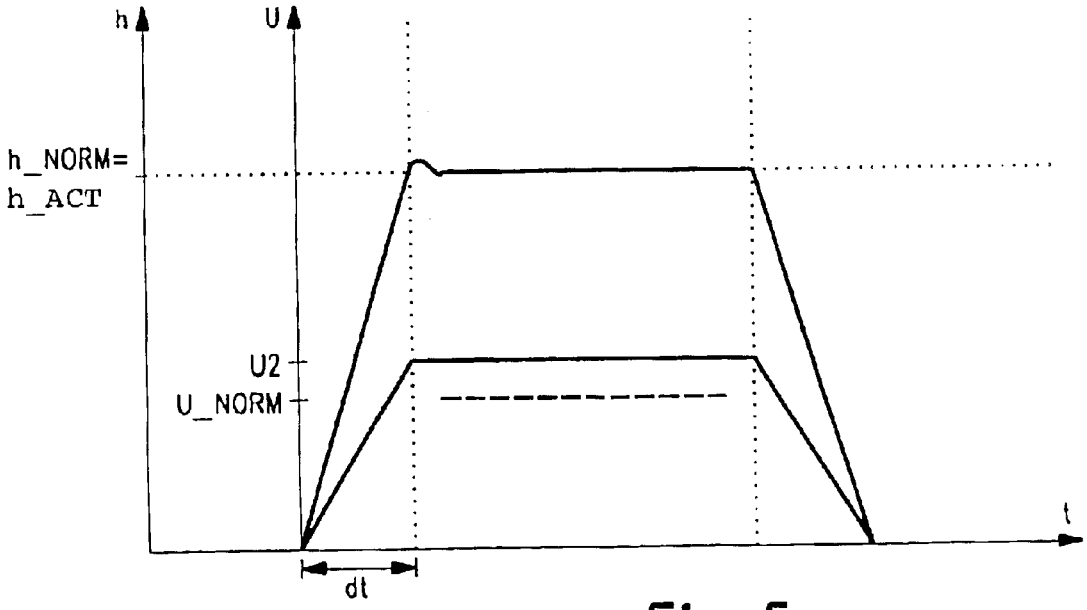

The effect of the method shown in FIG. 3 is set forth in FIGS. 4 and 5. First, in FIG. 4, the trace of the stroke h of the piezo actuator 50 and the trace of the drive voltage U are apparent when the influence quantities T, dx, dh and t or n are not considered. In this case, a standard drive voltage U_NORM is outputted by the output stage 35, which would lead to a stroke h_NORM under standard conditions. Because of the above influence quantities T, t, n, dx and dh, no standard conditions are, however, present in real operation. The actual stroke h_ACT, which is generated at the piezo actuator 50, is therefore less than the standard stroke h_NORM. The stroke gradient dh/dt is less than would be allowable without the piezo actuator 50 overshooting.

When the method shown in FIG. 3 is applied, the actual drive voltage U2 lies above the standard drive voltage U_NORM. Correspondingly, the voltage gradient dU2/dt is greater than the standard gradient dU_NORM/dt. The gradient dU2/dt is equal to dU_DES for an optimally operating output stage 35. The actual stoke h_ACT, which is generated at the piezo actuator, is equal to the desired norm stroke h_NORM because of the correction in the method blocks 64 and 66. Here, the maximum possible stroke velocity dh_NORM/dt is utilized for which the piezo actuator 50 just does not overshoot to an unwanted degree. With the application of the method shown in FIG. 3, a uniform optimal drive of the piezo actuator 50 is made possible over the entire service life of the piezo actuator.

It should be noted that the above method can also be utilized for intake manifold injection and for diesel engines.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine wherein fuel reaches a combustion chamber of said engine via a fuel injection device equipped with a piezo actuator, the method comprising the steps of:

providing means for supplying drive energy (U) for driving and actuating said piezo actuator with said drive energy (U) having a desired gradient (dU_DES); and, causing said desired gradient (dU_DES) to be dependent upon a plurality of influence quantities (T, t, n, dx, dh) which influence the operating behavior of said piezo actuator.

2. The method of claim 1, wherein the current values of said influence quantities (T, t, n, dx, dh) are used to generate a corrected desired drive energy (U_DES).

3. The method of claim 2, wherein: a standard drive energy (U_NORM) is defined, which must be supplied to said piezo actuator under standard conditions in order to achieve a specific actuation (h_NORM); the current values of said influence quantities (T, t, n, dx, dh) are determined; and, a corrective factor (CF_T, CF_nt, CF_dx, CF_dh), which corresponds to the current value of said influence quantities (T, t, n, dx, dh), is determined for each of said influence quantities (T, t, n, dx, dh); and, said corrective factor (CF_T, CF_nt, CF_dx, CF_dh) is superposed onto said standard drive energy (U_NORM) so that a corrected desired drive energy (U_DES) is determined.

4. The method of claim 1, wherein the current values of said influence quantities (T, t, n, dx, dh) are used to generate a corrected desired gradient (dU_DES) for the increase of said drive energy (U).

5. The method of claim 4, wherein a standard gradient is defined according to which said drive energy must be changed for standard conditions in order to achieve a specific actuation without said piezo actuator overshooting; the current values of said influence quantities (T, t, n, dx, dh) are determined or detected; a corrective factor (CF_T, CF_nt, CF_dx, CF_dh), which corresponds to the current value of said influence quantities (T, t, n, dx, dh), is determined for each of said influence quantities (T, t, n, dx, dh); and, said corrective factor (CF_T, CF_nt, CF_dx, CF_dh) is superposed onto said standard gradient so that a corrected desired gradient is determined.

6. The method of claim 4, wherein a corrected desired drive energy (U_DES) is divided by a time duration (dt) within which the corrected desired drive energy (U_DES) is reached without said piezo actuator overshooting; and, said corrected desired gradient (dU_DES) is determined therefrom.

7. The method of claim 3, wherein at least one corrective factor (CF_T, CF_dx, CF_dh) is determined with a characteristic line from the corresponding influence quantity (T, dx, dh).

8. The method of claim 3, wherein at least one of the corrected desired drive energy (U_DES) and the corrected desired gradient (dU_DES) is determined by at least one corrective function.

9. The method of claim 3, wherein at least one of said corrected desired drive energy (U_DES) and said corrected desired gradient (dU_DES) is determined by means of at least one of a characteristic line and a multi-dimensional characteristic field.

10. The method of claim 1, wherein said influence quantities (T, t, n, dx, dh) include at least two from the following group: temperature (T), deterioration (t, n), manufacturing tolerance (dx) and desired stroke (dh).

11. A computer program comprising a method, said computer program being run on a computer and the method being for operating an internal combustion engine wherein fuel reaches a combustion chamber of said engine via an injection device equipped with a piezo actuator, the method comprising the steps of:

providing means for supplying drive energy (U) for driving and actuating said piezo actuator with said drive energy (U) having a desired gradient (dU_DES); and, causing said desired gradient (dU_DES) to be dependent upon a plurality of influence quantities (T, t, n, dx, dh) which influence the operating behavior of said piezo actuator.

12. The computer program of claim 11, wherein said computer program is stored on a memory including a flash memory.

13. A control apparatus for operating an internal combustion engine, the control apparatus comprising: a memory storing a computer program for carrying out a method for operating an internal combustion engine wherein fuel reaches a combustion chamber of said engine via an injection device equipped with a piezo actuator, the method including the steps of: providing means for supplying drive energy (U) for driving and actuating said piezo actuator with said drive energy (U) having a desired gradient (dU_DES); and, causing said desired gradient (dU_DES) to be dependent upon a plurality of influence quantities (T, t, n, dx, dh) which influence the operating behavior of said piezo actuator.

14. An internal combustion engine comprising:

a combustion chamber;

an injection device via which fuel reaches said combustion chamber and said injection device including a piezo actuator;

a control apparatus providing means for supplying drive energy (U) for driving and actuating said piezo actuator with said drive energy (U) having a desired gradient (dU_DES); and, said control apparatus including means for causing said desired gradient (dU_DES) to be dependent upon a plurality of influence quantities (T, t, n, dx, dh) which influence the operating behavior of said piezo actuator.

15. A method for operating an internal combustion engine wherein fuel reaches a combustion chamber of said engine via a fuel injection device equipped with a piezo actuator, the method comprising the steps of:

providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

determining the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

16. A computer program for carrying out a method, said computer program being run on a computer and the method being for operating an internal combustion engine wherein fuel reaches a combustion chamber of said engine via an injection device equipped with a piezo actuator, the method comprising the steps of:

providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

determining the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

17. The computer program of claim 16, wherein said computer program is stored on a memory including a flash memory.

18. A control apparatus for operating an internal combustion engine, the control apparatus comprising: a memory storing a computer program for carrying out a method for operating an internal combustion engine wherein fuel reaches a combustion chamber of said engine via an injection device equipped with a piezo actuator, the method including the steps of: providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

determining the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

19. An internal combustion engine comprising:

a combustion chamber;

an injection device via which fuel reaches said combustion chamber and said injection device including a piezo actuator;

a control apparatus providing means for supplying drive energy (U) for driving and actuating said piezo actuator with said drive energy (U) having a desired level (U_DES); and, said control apparatus including means for causing said desired level (U_DES) to be dependent upon a plurality of influence quantities (T, t, n, dx, dh) which influence the operating behavior of said piezo actuator;

said control apparatus including means for defining a standard drive energy (U_NORM), which must be supplied to said piezo actuator under standard conditions in order to achieve a specific actuation (h_NORM);

said control apparatus including means for determining the current values of said influence quantities (T, t, n, dx, dh);

said control apparatus including means for determining for each of said influence quantities (T, t, n, dx, dh) a corrective factor (CF_T, CF_nt, CF_dx, CF_dh), which corresponds to the current value of said influence quantities (T, t, n, dx, dh); and said control apparatus including means for superimposing said corrective factor (CF_T, CF_nt, CF_dx, CF_dh) onto said standard drive energy (U_NORM) so that a corrected desired drive energy (U_DES) is determined.

20. The method of claim 2, wherein: a standard drive energy (U_NORM) is defined, which must be supplied to said piezo actuator under standard conditions in order to achieve a specific actuation (h_NORM); the current values of said influence quantities (T, t, n, dx, dh) are detected; and, a corrective factor (CF_T, CF_nt, CF_dx, CF_dh), which corresponds to the current value of said influence quantities (T, t, n, dx, dh), is determined for each of said influence quantities (T, t, n, dx, dh); and, said corrective factor (CF_T, CF_nt, CF_dx, CF_dh) is superposed onto said standard drive energy (U_NORM) so that a corrected desired drive energy (U_DES) is determined.

21. A method for operating an internal combustion engine wherein fuel reaches a combustion chamber of said engine via a fuel injection device equipped with a piezo actuator, the method comprising the steps of:

providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

detecting the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

22. A computer program for carrying out a method, said computer program being run on a computer and the method being for operating an internal combustion engine wherein fuel reaches a combustion chamber of said engine via an injection device equipped with a piezo actuator, the method comprising the steps of:

providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

detecting the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

23. A control apparatus for operating an internal combustion engine, the control apparatus comprising: a memory storing a computer program for carrying out a method for operating an internal combustion engine wherein fuel reaches a combustion chamber of said engine via an injection device equipped with a piezo actuator, the method including the steps of: providing means for supplying drive energy (U) for driving and actuating said piezo actuator with said drive energy (U) having a desired level (U_DES);

causing said desired level (U_DES) to be dependent upon a plurality of influence quantities (T, t, n, dx, dh) which influence the operating behavior of said piezo actuator;

defining a standard drive energy (U_NORM), which must be supplied to said piezo actuator under standard conditions in order to achieve a specific actuation (h_NORM);

detecting the current values of said influence quantities (T, t, n, dx, dh);

determining for each of said influence quantities (T, t, n, dx, dh) a corrective factor (CF_T, CF_nt, CF_dx, CF_dh), which corresponds to the current value of said influence quantities (T, t, n, dx, dh); and superimposing said corrective factor (CF_T, CF_nt, CF_dx, CF_dh) onto said standard drive energy (U_NORM) so that a corrected desired drive energy (U_DES) is determined.

24. An internal combustion engine comprising:

a combustion chamber;

an injection device via which fuel reaches said combustion chamber and said injection device including a piezo actuator;

a control apparatus providing means for supplying drive energy (U) for driving and actuating said piezo actuator with said drive energy (U) having a desired level (U_DES); and, said control apparatus including means for causing of said desired level (U_DES) to be dependent upon a plurality of influence quantities (T, t, n, dx, dh) which influence the operating behavior of said piezo actuator;

said control apparatus including means for defining a standard drive energy (U_NORM), which must be supplied to said piezo actuator under standard conditions in order to achieve a specific actuation (h_NORM);

said control apparatus including means for detecting the current values of said influence quantities (T, t, n, dx, dh);

said control apparatus including means for determining for each of said influence quantities (T, t, n, dx, dh) a corrective factor (CF_T, CF_nt, CF_dx, CF_dh), which corresponds to the current value of said influence quantities (T, t, n, dx, dh); and said control apparatus including means for superimposing said corrective factor (CF_T, CF_nt, CF_dx, CF_dh) onto said standard drive energy (U_NORM) so that a corrected desired drive energy (U_DES) is determined.

* * * * *